US006579118B2

(12) United States Patent
Endo

(10) Patent No.: US 6,579,118 B2
(45) Date of Patent: Jun. 17, 2003

(54) HALF-FITTING PREVENTION CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/166,081

(22) Filed: Jun. 11, 2002

(65) Prior Publication Data

US 2003/0003792 A1 Jan. 2, 2003

(30) Foreign Application Priority Data

Jun. 12, 2001 (JP) ..... 2001-177292

(51) Int. Cl.[7] ..... H01R 3/00
(52) U.S. Cl. ..... 439/489; 439/352
(58) Field of Search ..... 439/488, 489, 439/352, 353, 357, 358

(56) References Cited

U.S. PATENT DOCUMENTS

| | | | | |
|---|---|---|---|---|
| 5,507,666 A | | 4/1996 | Yamanashi | |
| 5,827,086 A | | 10/1998 | Fukuda | |
| 5,848,912 A | | 12/1998 | Okabe | |
| 5,938,470 A | | 8/1999 | Kashiyama | |
| 5,947,763 A | * | 9/1999 | Alaksin | 439/489 |
| 6,012,946 A | * | 1/2000 | Fukase | 439/489 |
| 6,027,364 A | | 2/2000 | Fukuda | |
| 6,171,130 B1 | | 1/2001 | Yoshida et al. | |

FOREIGN PATENT DOCUMENTS

| | | |
|---|---|---|
| EP | 0 774 804 A2 | 5/1997 |
| EP | 0 821 441 A2 | 1/1998 |
| EP | 0 981 185 A2 | 2/2000 |
| EP | 1 113 537 A2 | 7/2001 |
| EP | 1 180 825 A2 | 2/2002 |
| JP | 8-031517 | 2/1996 |

* cited by examiner

*Primary Examiner*—Tho D. Ta
(74) *Attorney, Agent, or Firm*—Sughrue Mion, PLLC

(57) ABSTRACT

A half-fitting prevention connector includes a female connector having a flexible lock arm, a male connector for fitting into the female connector, and a fitting detection member which is mounted on the female connector to slide in a fitting direction of the two connectors, and a half-fitted condition of the two connectors is detected by determining whether or not the fitting detection member can be slidingly moved. The fitting detection member includes a deflection prevention rib which is formed at a rear end thereof to prevent the deflection of the lock arm in a completely-fitted condition. When the completely-fitted condition is achieved, this deflection prevention rib is slid under the lock arm to prevent the deflection of the flexible lock arm. Therefore, even when a load is applied to the flexible lock arm, the locked condition will not be canceled, thereby stabling maintaining the fitted condition.

2 Claims, 9 Drawing Sheets

HALF-FITTING PREVENTION CONNECTOR

The present application is based on Japanese Patent Application No. 2001-177292, the entire contents of which are incorporated herein by reference.

BACKGROUND OF THE INVENTION

1. Field of the Invention

This invention relates to a half-fitting prevention connector in which when a pair of male and female connector housings are fitted together, a half-fitted condition of the male and female connector housings is detected by determining whether or not a fitting detection member, mounted on one of the connector housings, can be slid into a proper fitting detection position.

2. Related Art

In a conventional half-fitting prevention connector shown in FIGS. 7 and 8, when a pair of male and female connector housings 1 and 9 are fitted together, a half-fitted condition of the male and female connector housings 1 and 9 is detected by determining whether or not a fitting detection member 2, mounted on the male connector housing (first connector housing) 1, can be slid into a proper fitting detection position (see JP-A-8-31517).

As shown in FIG. 8, the male connector housing 1 has a flexible lock arm 4 rising from an upper wall 3 at a front end thereof and further extending toward a rear end of the housing, and a lock portion 6 is formed on an intermediate portion of an upper surface of this flexible lock arm 4 in a projected manner.

A pressing plate portion 7 is provided at a free end of the flexible lock arm 4 disposed near to the rear end of the male connector housing 1, and this pressing plate portion 7 serves as an operating portion for elastically displacing the flexible lock arm 4 when fitting the male and female connector housings together.

The female connector housing 9 has an engagement portion 10 formed on an inner surface of an upper wall thereof at a front end thereof which upper wall overlies the flexible lock arm 4 when fitting the male and female connector housings 1 and 9 together.

As shown in FIGS. 9 and 10, when the length of fitting of the male and female connector housings 1 and 9 relative to each other reaches a proper value, the engagement portion 10 slides over the lock portion 6 through the elastic displacement of the flexible lock arm 4. When the length of fitting of the male and female connector housings 1 and 9 reaches the proper value, the engagement portion 10 becomes engaged in a recess 6*a,* disposed at the rear side of the lock portion 6, from the upper side, to retain the lock portion 6, thereby locking the male and female connector housings 1 and 9 in a fitted condition.

As shown in FIGS. 7 and 8, the fitting detection member 2 includes an operating plate portion 16, which is slidably engaged with the pressing plate portion 7 so as to slide in a fitting direction of the male and female connector housings, a resilient piece portion 17, extending from a rear end of the operating plate portion 16 toward the front ends of the male and female connector housings, and a positioning retaining portion 20 formed at a distal end of the resilient piece portion 17 in a projected manner, these portions being formed integrally with one another. The resilient piece portion 17 has a bar-like shape, and can pass through a space between a pair of side plate portions 5 and 5 of the flexible lock arm 4.

As shown in FIG. 7, the positioning retaining portion 20 is in the form of a projection, and can be fitted into each of recesses 6*a* and 6*b,* disposed respectively at the rear and front sides of the lock portion 6, from the lower side by the resilient force of the resilient piece portion 17. Before the male and female connector housings are fitted together, this positioning retaining portion 20 is kept fitted in the recess 6*a* at the rear side of the lock portion 6, and is retained by a rear edge of the lock portion 6, and therefore is prevented form forward movement.

The position where the positioning retaining portion 20 is abutted against the rear edge of the lock portion 6, and is prevented from forward movement is an initial position of the fitting detection member 2 mounted on the male connector housing 1.

With respect to the sliding engagement between the pressing plate portion 7 and the operating plate portion 6, the sliding range is so determined that the fitting detection member 2 can slide between the proper fitting detection position, set forwardly of the above initial position, and this initial position.

When the pair of male and female connector housings 1 and 9 are fitted together, the length of fitting of the male and female connector housings 1 and 9 reaches the proper value, so that the engagement portion 10 is fitted in the recess 6*a* at the rear side of the lock portion 6, as shown in FIG. 10.

Therefore, the positioning retaining portion 20 of the fitting detection member 2, already fitted in the recess 6*a,* is downwardly pushed out of this recess by the engagement portion 10, so that the holding of the positioning retaining portion 20 in the initial position is canceled. As a result, the fitting detection member 2 can be slid by pushing the operating plate portion 16 forward as indicated by arrow A in the drawings.

When the fitting detection member 2 is pushed forward after the holding of the positioning retaining portion 20 in the initial position is canceled, this positioning retaining portion 20 moves forward in sliding contact with the lower surfaces of the engagement portion 10 and lock portion 6, as shown in FIG. 11. Then, when the positioning retaining portion 20 moves past the front edge of the lock portion 6, this portion 20 is displaced upwardly by the resilient force of the resilient piece portion 17, and is fitted into the recess 6*b* at the front side of the lock portion 6.

Therefore, the positioning retaining portion 20, thus fitted in the recess 6*b,* is retained at its rear end surface by the front end surface of the lock portion 6, and is held in a locked condition, that is, prevented from rearward sliding movement.

However, if the length of fitting of the male and female connector housings 1 and 9 does not reach the proper value, thus inviting a half-fitted condition, when the male and female connector housings 1 and 9 are fitted together, the engagement portion 10 of the female connector housing 9 will not be fitted into the recess 6*a* at the rear side of the lock portion 6.

Therefore, the positioning retaining portion 20 will not be pushed out of the recess 6*a* by the engagement portion 10, and therefore the holding of the fitting detection member 2 in the initial position by the lock portion 6 will not be canceled.

Therefore, in the half-fitted condition of the male and female connector housings 1 and 9, even when the operating plate portion 16 of the fitting detection member 2 is pushed forward, the fitting detection member 2 will not be moved forward, and therefore the half-fitted condition can be detected by determining whether or not the fitting detection member 2 can be moved forward.

After the male and female connector housings 1 and 9 are fitted together, the operating plate portion 16 of the fitting detection member 2 is exposed, and therefore there was encountered a problem that when an external force of above a predetermined level acted on the operating plate portion 16 from the upper side, the flexible lock arm 4 was elastically deformed (since a deflection space was provided between the flexible lock arm 4 and the male connector housing 1), so that the locking of the male and female connector housings 1 and 9 to each other was canceled.

SUMMARY OF THE INVENTION

This invention has been made in view of the above problem, and an object of the invention is to provide a half-fitting prevention connector in which the deflection of a lock arm is prevented in a completely-fitted condition, thereby stably maintaining the fitted condition.

The above object has been achieved by a half-fitting prevention connector of the invention of claim 1 which comprises:

a first connector housing having a flexible lock arm;

a second connector housing which has an engagement portion for engagement with a lock portion of the flexible lock arm, and is connected to the first connector housing by the engagement of the lock portion with the engagement portion when the second connector housing is fitted relative to the first connector housing; and a fitting detection member which is mounted on the first connector housing so as to slide in a fitting direction of the first and second connector housings, a half-fitted condition of the first and second connector housings being detected by determining whether or not the fitting detection member can be slidingly moved; characterized in that:

the fitting detection member includes a detection member body, which is fitted on an outer periphery of the first connector housing so as to slide in the fitting direction of the first and second connector housings, a positioning retaining portion for engagement with the lock portion to hold the detection member body in an initial position, and a deflection prevention rib which is formed at a rear end of the fitting detection member so as to prevent the deflection of the lock arm in a completely-fitted condition;

when the first and second connector housings are completely fitted together, the positioning retaining portion is pushed out of the lock portion upon engagement of the engagement portion with the lock portion, so that the engagement of the positioning retaining portion with the lock portion is canceled; and when the detection member body is slid from the initial position to a proper fitting detection position generally near to a front end of the first connector housing, the positioning retaining portion is engaged with a detection member-retaining portion, formed at a distal end of the lock arm, thereby holding the fitting detection member in the proper fitting detection position, and also the deflection prevention rib is slid under the lock arm to prevent the deflection of the lock arm.

In the half-fitting prevention connector of the above construction, the deflection prevention rib for preventing the deflection of the lock arm in the completely-fitted condition is formed at the rear end of the fitting detection member mounted on the first connector housing, and when the completely-fitted condition is achieved, the deflection prevention rib slides under the lock arm to prevent the deflection of the lock arm. Therefore, even when a load is applied to the lock arm, the locked condition will not be canceled, thereby stably maintaining the fitted condition.

The deflection prevention rib may take any suitable form, and does not always need to extend between the opposite side walls of the detection member body in so far as it can generally fill up a deflection space for the flexible lock arm. Namely, the deflection prevention rib may be interrupted intermediate the opposite side walls of the detection member body, and may comprise two cantilever sections.

In the half-fitting prevention connector of the invention of claim 2 depending from claim 1, the first connector housing has a first projection formed on that portion of an outer peripheral surface thereof facing away from the flexible lock arm, and the fitting detection member has a second projection which is formed on an inner peripheral surface thereof so as to be engaged with the first projection in the completely-fitted condition of the first and second connector housings, and when the first connector housing is completely fitted with the second connector housing, the fitting detection member moves toward the front side of the first connector housing, so that the second projection slides past the first projection, and is engaged therewith.

In the half-fitting prevention connector of this construction, the first connector housing has the first projection formed on that portion of the outer peripheral surface thereof facing away from the flexible lock arm, and the fitting detection member has the second projection which is formed on the inner peripheral surface thereof so as to be engaged with the first projection in the completely-fitted condition of the first and second connector housings, and when the first connector housing is completely fitted with the second connector housing, the fitting detection member moves toward the front side of the first connector housing, so that the second projection slides past the first projection, and is engaged therewith. Thus, the positioning retaining portion is engaged with the detection member-retaining portion, formed at the distal end of the lock arm, and in addition the first projection is engaged with the second projection. Therefore, the force of retaining of the fitting detection member on the first connector housing in the completely-fitted condition increases, thereby more firmly holding the fitting detection member in the proper fitting detection position. And besides, when the first projection and the second projection are engaged with each other, a click feeling is produced, and the completely-fitted condition of the first and second connector housings can be detected also by this click feeling.

BRIEF DESCRIPTION OF THE PREFERRED EMBODIMENT

Figure 1:
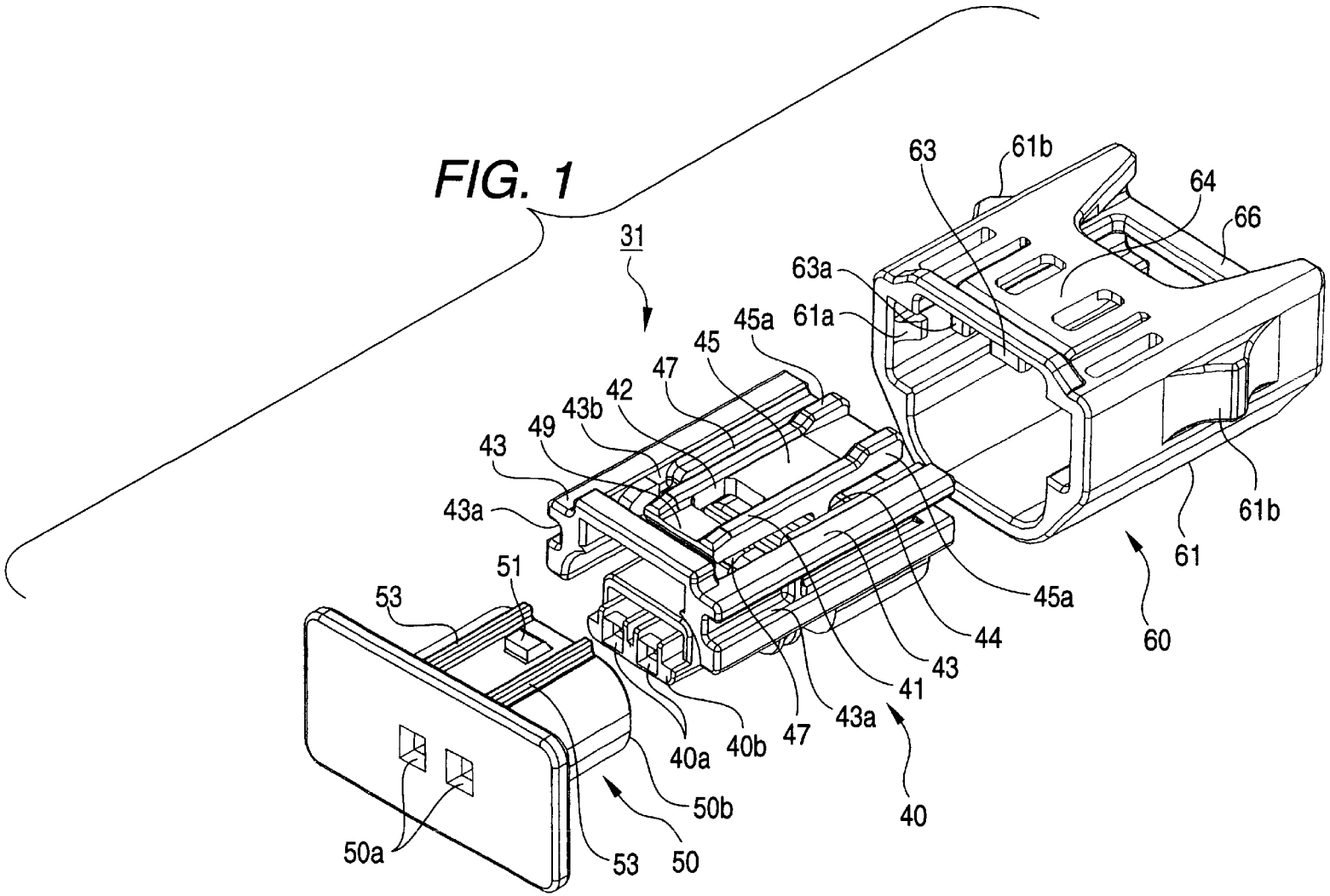
FIG. 1 is an exploded, perspective view of a first embodiment of a half-fitting prevention connector of the present invention.
Figure 4:
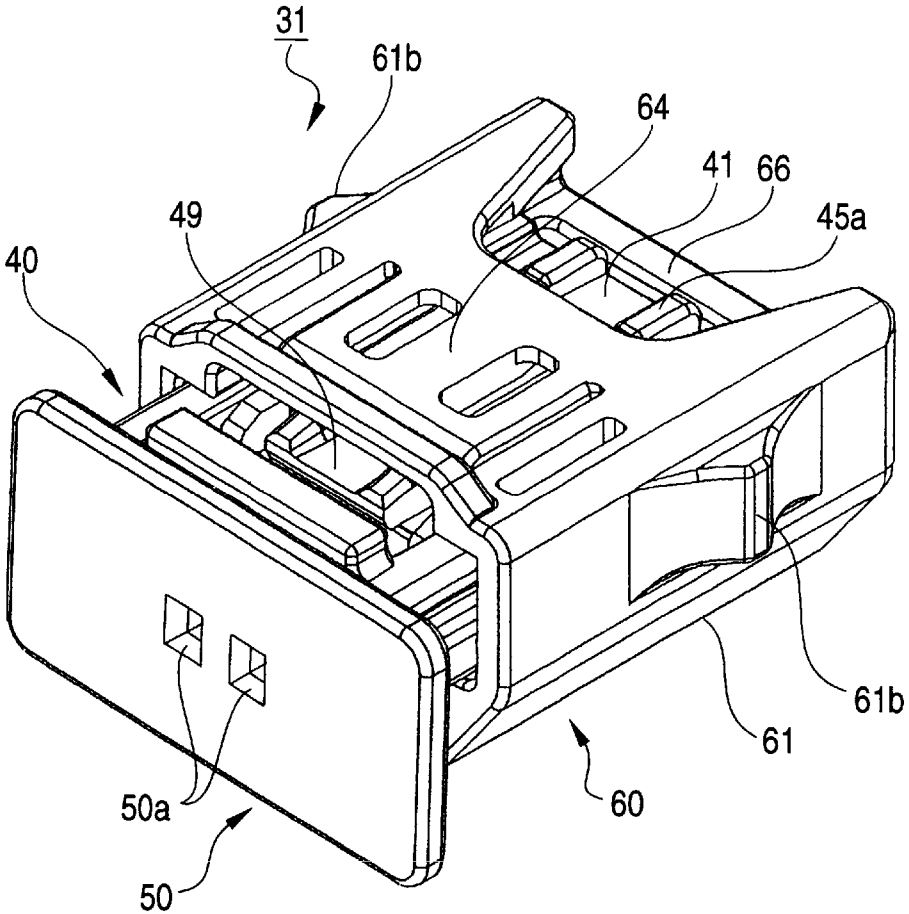
FIG. 4 is a perspective view showing a condition in which the female and male connector housings of FIG. 1 are in the process of being fitted together.
Figure 5:
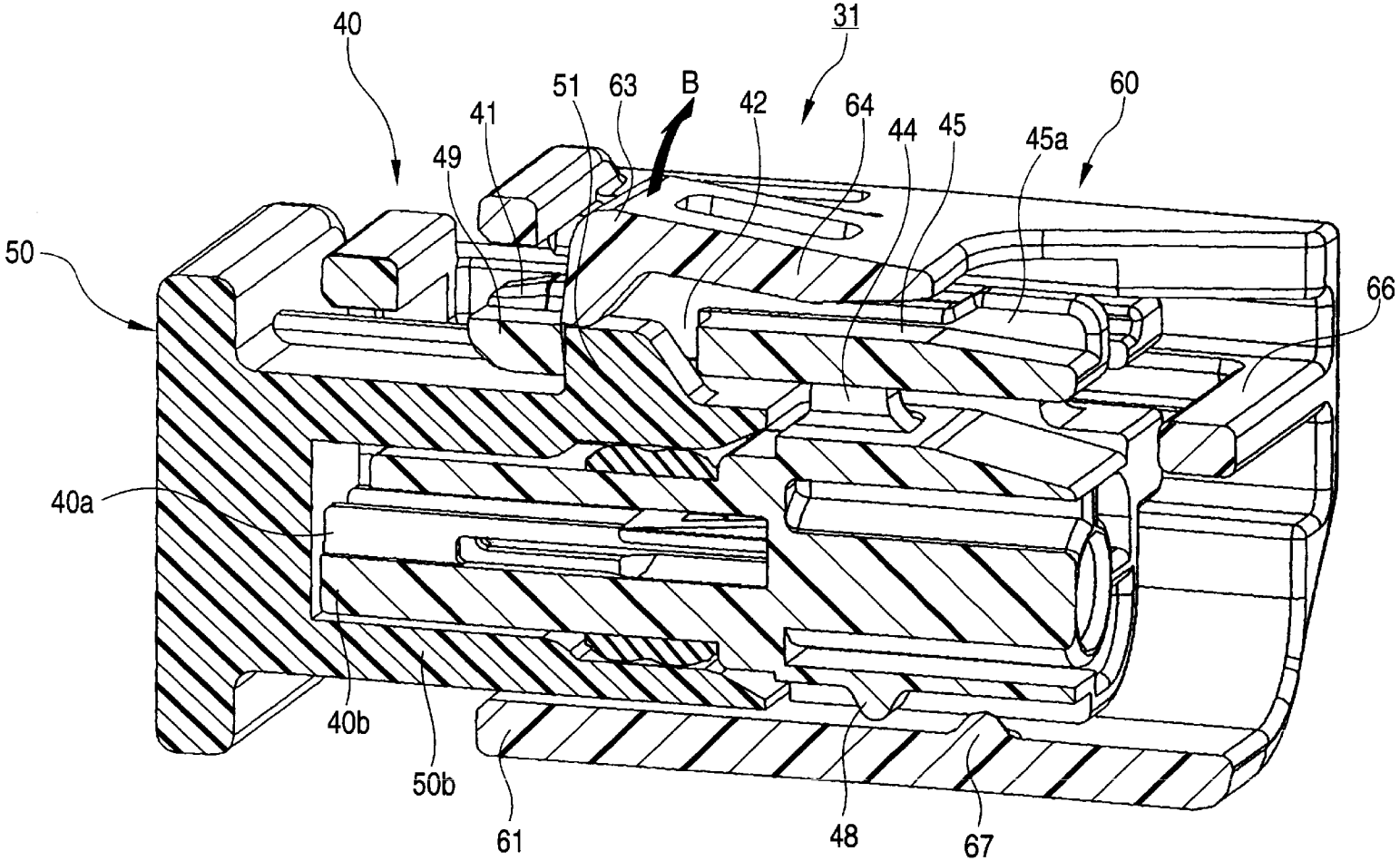
FIG. 5 is a vertical cross-sectional view in FIG. 4.
Figure 6:
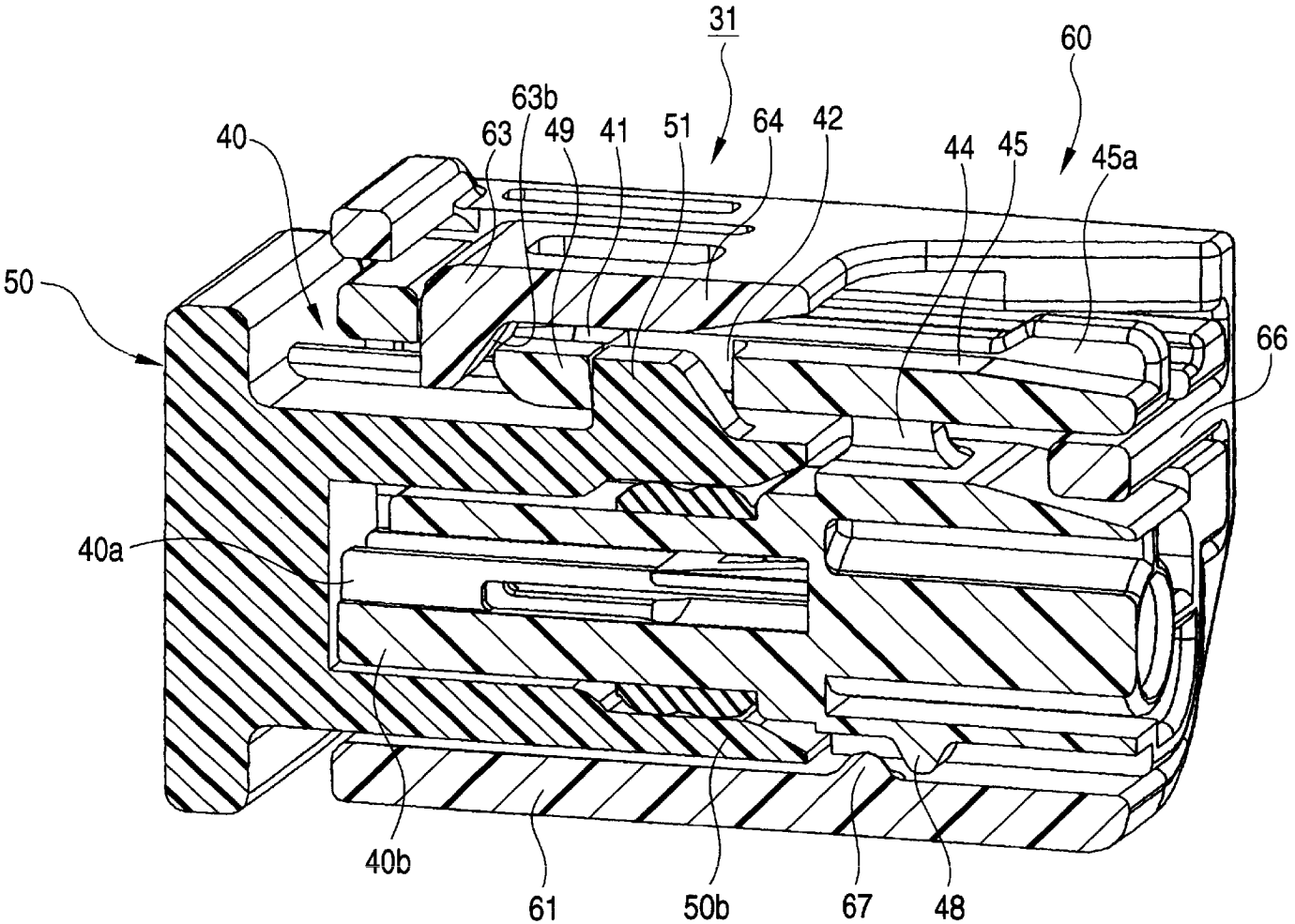
FIG. 6 is a vertical cross-sectional view showing the female and male connector housings of FIG. 5 in a completely-fitted condition.
Figure 7:
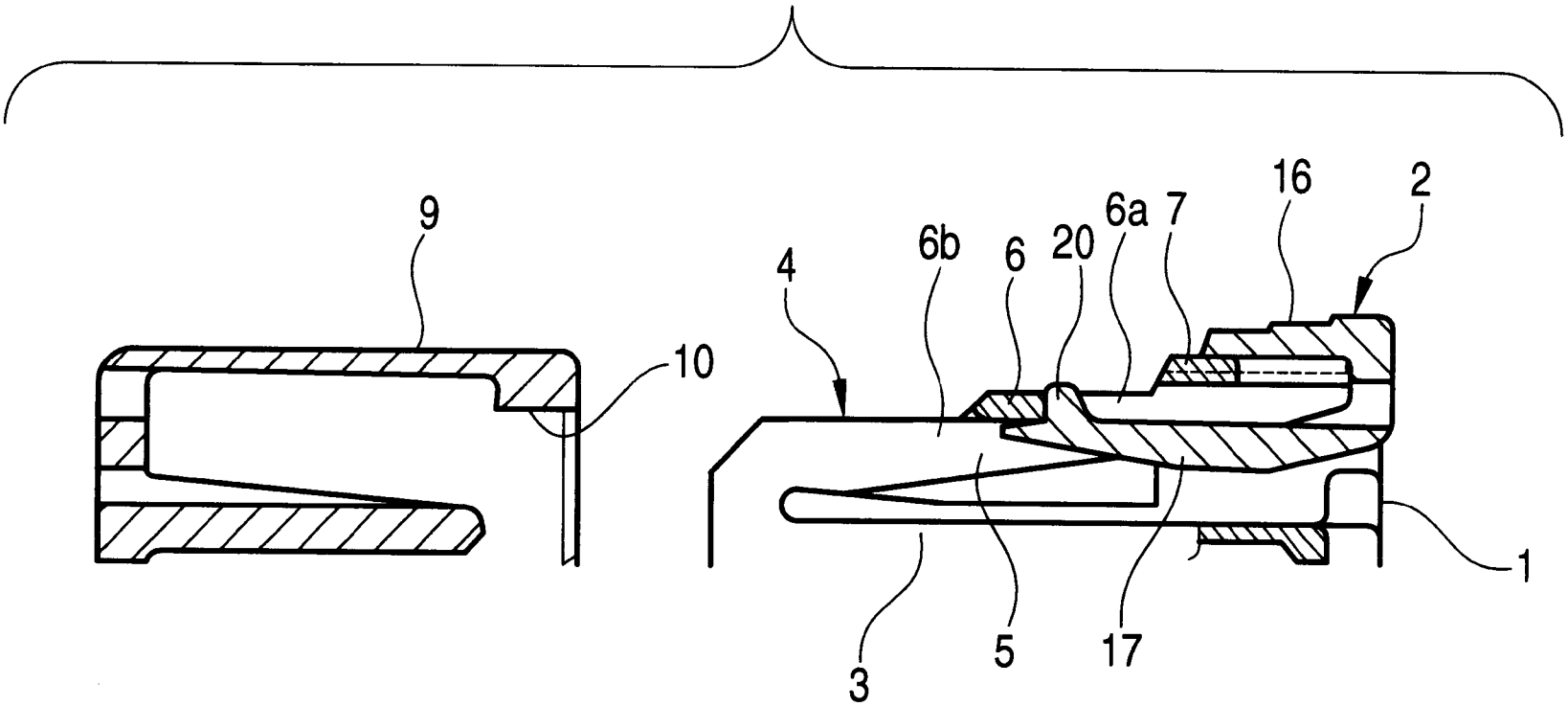
FIG. 7 is a vertical cross-sectional view of a conventional half-fitting connector showing a condition before it is brought into a fitted condition.
Figure 8:
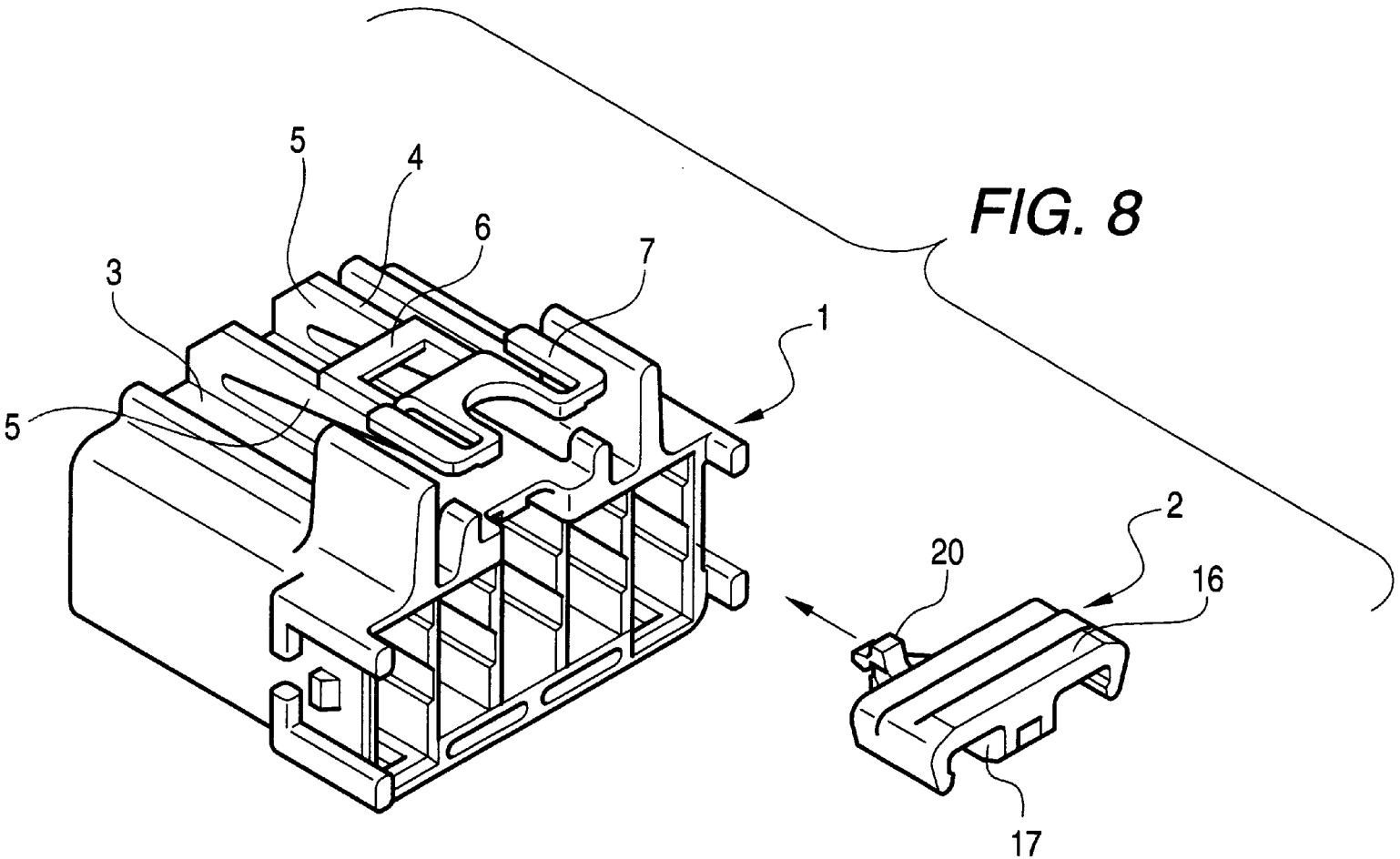
FIG. 8 is an exploded, perspective view showing a male connector housing and a fitting detection member of FIG. 7.
Figure 9:
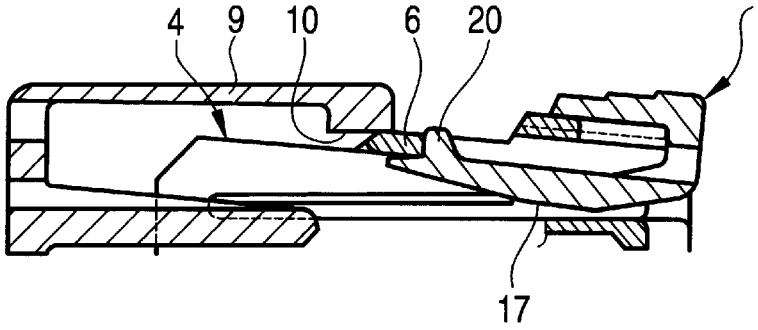
FIG. 9 is a vertical cross-sectional view of an important portion showing a fitting process in FIG. 7.
Figure 10:
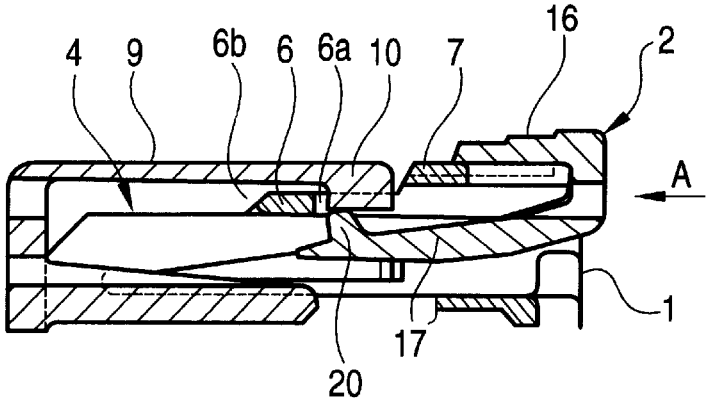
FIG. 10 is a fragmentary, vertical cross-sectional view showing a condition in which an engagement portion of the second connector housing is engaged with a lock portion of first connector housing in FIG. 7.
Figure 11:
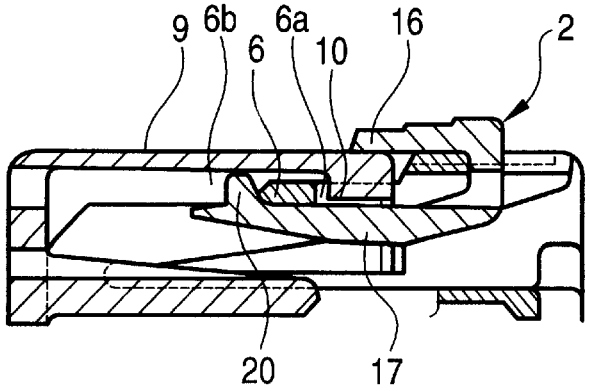
FIG. 11 is a fragmentary, vertical cross-sectional view showing a condition in which the fitting of the first and second connector housings of FIG. 7 has been completed, and the fitting detection member has been slid into a proper fitting detection position.

One embodiment of a half-fitting prevention connector of the present invention will now be described in detail with reference to FIGS. 1 to 6. FIG. 1 is an exploded, perspective view of one preferred embodiment of the half-fitting prevention connector of the invention, FIG. 2 is a perspective view showing a condition in which a fitting detection member is mounted on a female connector housing of FIG. 1, FIG. 3 is a vertical cross-sectional view in FIG. 2, FIG. 4 is a perspective view showing a condition in which the female and male connector housings of FIG. 1 are in the process of being fitted together, FIG. 5 is a vertical cross-sectional view in FIG. 4, and FIG. 6 is a vertical cross-sectional view showing the female and male connector housings of FIG. 5 in a completely-fitted condition.

As shown in FIG. 1, the half-fitting prevention connector 31 of this embodiment comprises a female connector (first connector housing) 40, having a flexible lock arm 41, a male connector (the second connector housing) 50 having an engagement projection (engagement portion) 51 for engagement in a retaining hole 42 (serving as a lock portion) formed in the flexible lock arm 41, and the fitting detection member 60 of a generally tubular shape mounted on the female connector 40 so as to slide in a fitting direction.

Figure 2:
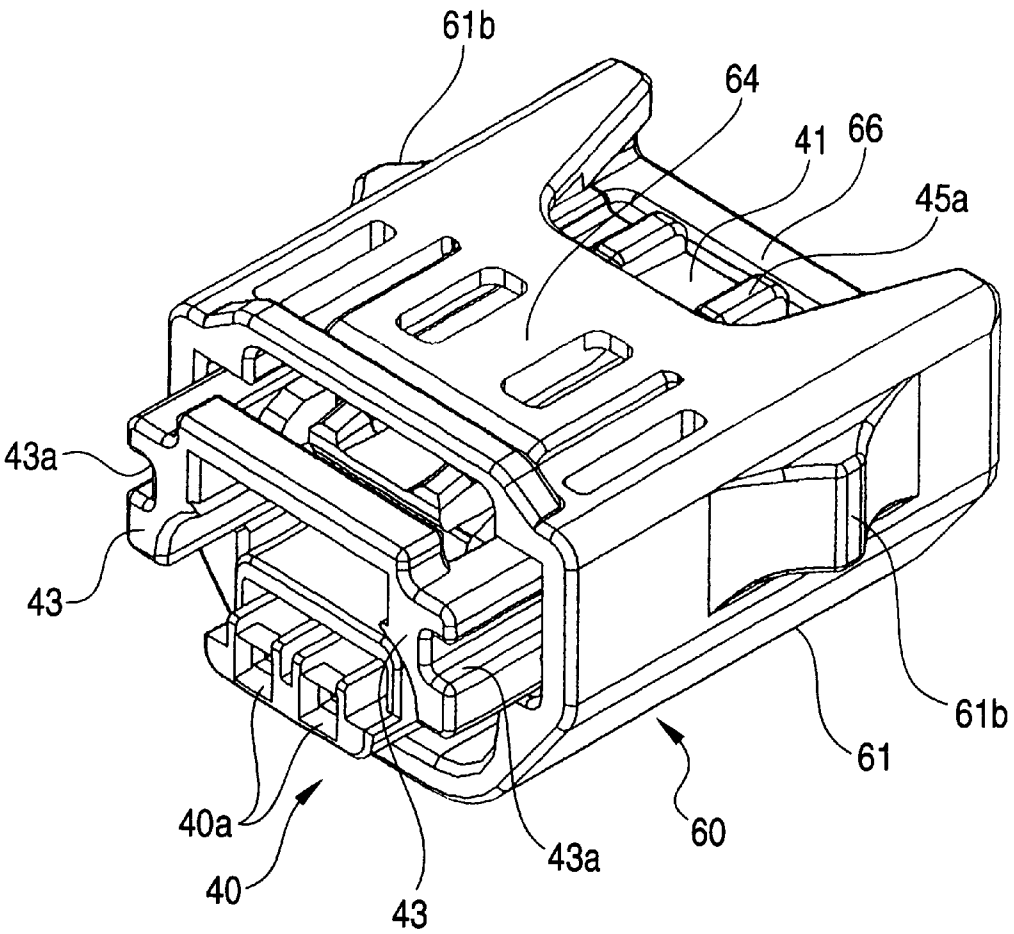
FIG. 2 is a perspective view showing a condition in which a fitting detection member is mounted on a female connector housing of FIG. 1.
Figure 3:
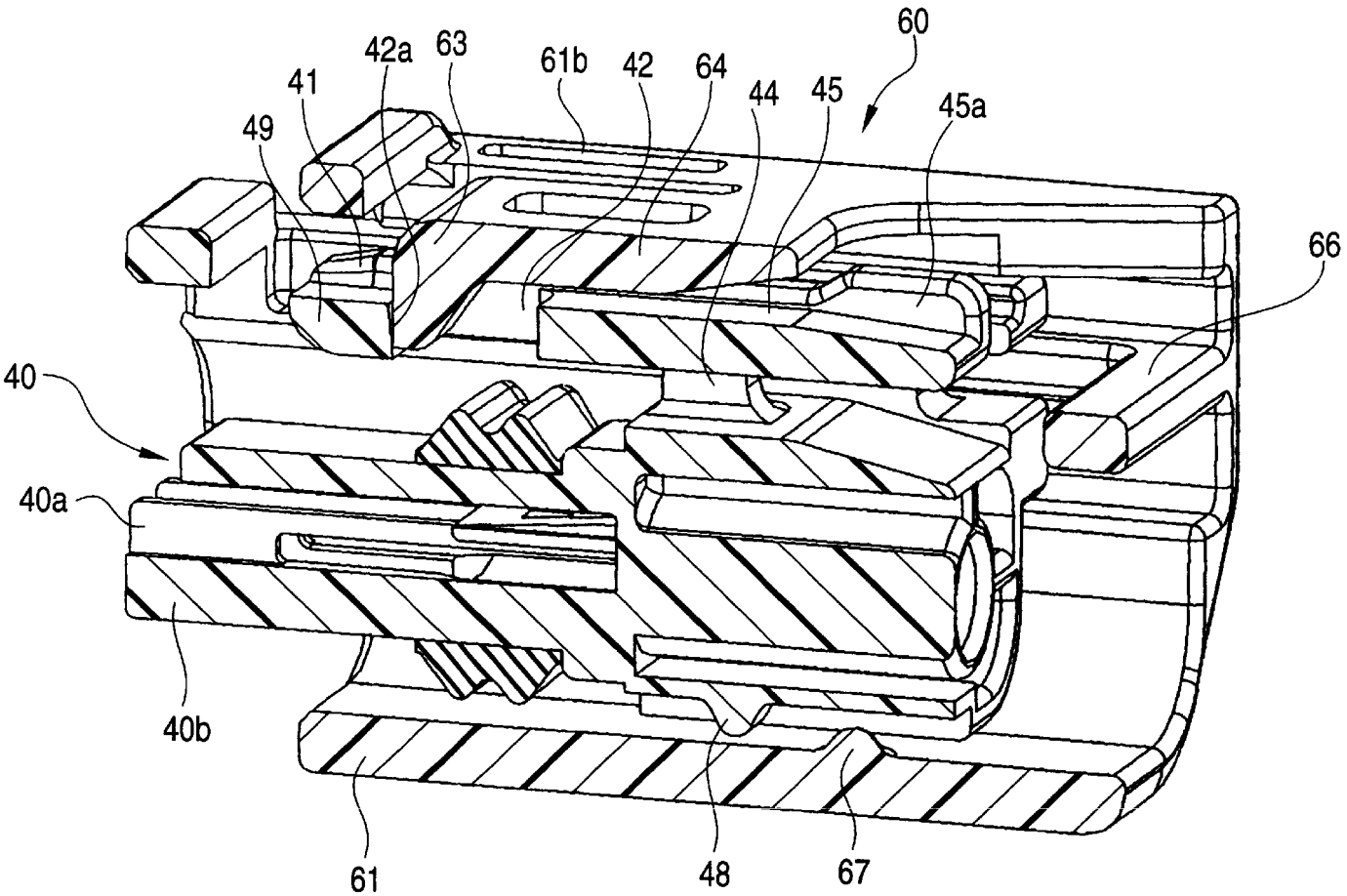
FIG. 3 is a vertical cross-sectional view in FIG. 2.

Before the female and male connectors 40 and 50 are fitted together, the fitting detection member 60 is engaged in the retaining hole 42, and therefore is held in its initial position, as shown in FIGS. 2 and 3. When the female and male connectors 40 and 50 are completely fitted together, the retaining of the fitting detection member by the retaining hole 42 is canceled by engagement of the engagement projection 51 in the retaining hole 42, and the fitting detection member is slid from the initial position to a proper fitting detection position spaced a predetermined distance from the initial position, as shown in FIGS. 5 and 6. Therefore, a half-fitted condition of the female and male connectors 40 and 50 can be detected by determining whether or not the fitting detection member 60 can be slid into the proper fitting detection position.

The female connector 40 of this embodiment includes a housing body 40*b*, having terminal receiving chambers 40*a* for respectively receiving and holding female connection terminals (not shown), the flexible lock arm 41, formed on an upper surface of the housing body, and guide portions 43 for slidably supporting the fitting detection member 60, these portions being molded integrally with one another.

The flexible lock arm 41 includes an arm portion 45 formed on upper ends of support post portions 44 formed on a generally central portion of the upper surface of the housing body 40*b*, and the arm portion 45 extends in a forward-rearward direction relative to the housing body 40*b*, and can be elastically displaced upward and downward on the support post portions 44 serving as a fulcrum.

In the flexible lock arm 41, the retaining hole 42 is formed through that portion of the arm portion 45 disposed near to the front end thereof. Cancellation operating portions 45*a* for upwardly displacing the front end of the arm portion 45 are formed on that portion of the upper surface of the arm portion 45 disposed adjacent to the rear end thereof.

Therefore, in the fitted condition of the female and male connectors 40 and 50 in which the engagement projection 51 of the male connector 50 is engaged in the retaining hole 42, when the cancellation operating portions 45*a* are depressed to displace the front end of the arm portion 45 upwardly, the engagement of the engagement projection 51 in the retaining hole 42 is canceled.

The guide portions 43 are formed respectively at opposite sides of the upper surface of the housing body 40*b* in such a manner that the flexible lock arm 41 is disposed between these guide portions 43. Each of the guide portions 43 has a guide groove 43*a* formed in an outer surface thereof and extending in the forward-rearward direction of the housing body 40*b*.

As shown in FIG. 3, the female connector 40 of this embodiment has a first projection 48 of a rib-like shape formed on that portion of the outer peripheral surface thereof facing away from the flexible lock arm 41, the first projection 48 extending transversely, that is, in a direction perpendicular to the fitting direction. Preferably, the first projection 48 has a triangular cross-sectional shape, having gently-slanting surfaces, or a semi-circular cross-sectional shape.

The male connector 50 of this embodiment includes a housing body 50*b* having terminal receiving chambers 50*a* for respectively receiving male connection terminals (not shown), and the engagement projection 51 for engagement in the retaining hole 42 is formed on an upper surface of this housing body, and elongate projections 53 each for passing through a gap 47 between the flexible lock arm 41 and the corresponding guide portion 43 is also formed on this upper surface.

The terminal receiving chambers 50*a* receive and hold the male connection terminals (not shown) which are to be connected respectively to the female connection terminals received respectively in the terminal receiving chambers 40*a* in the female connector 40, and these terminal receiving chambers 50*a* are arranged at the same pitch as that of the terminal receiving chambers 40*a*.

The engagement projection 51 is formed on and projects from that portion of the upper surface of the housing body 50*b* disposed near to the front end thereof. When the female and male connectors 40 and 50 are fitted together, the engagement projection 51 moves into sliding contact with the lower surface of the arm portion 45 of the flexible lock arm 41. Then, when the length of fitting of the female and male connectors relative to each other reaches a predetermined value, this engagement projection is fitted into the retaining hole 42 from the lower side of the arm portion 45, and is thus engaged in this retaining hole.

The elongate projections 53 are passed respectively through the gaps 47, provided in the female connector 40, thereby controlling the fitting direction of the female and male connectors 40 and 50 and the fitting positions thereof so that the operation for fitting the female and male connectors 40 and 50 together can be carried out smoothly.

The fitting detection member 60 of this embodiment includes a detection member body 61 of a generally tubular shape, which is fitted on the outer periphery of the female connector 40 so as to slide in the fitting direction of the female and male connectors 40 and 50 together, and covers the outer periphery of the hosing body 40*b,* a retaining projection 63 (serving as a positioning retaining portion) for engagement in the retaining hole 42 to hold the detection member body 61 in the initial position, a deflection prevention rib 66 formed at a rear end of the detection member body 61 so as to prevent the deflection of the flexible lock arm 41 in the completely-fitted condition, and a second projection 67 of a boss-like shape formed on the inner peripheral surface of the detection member body so as to be engaged with the first projection 48 in the completely-fitted condition.

Guide projections 61*a* for being slidably fitted respectively in the guide grooves 43*a* of the guide portions 43 are formed respectively on inner side surfaces of the detection member body 61, and this detection member body is mounted on the female connector 40 so as to slide in the fitting direction of the female and male connectors 40 and 50 through the guide projections 61*a* fitted respectively in the guide grooves 43*a*.

Anti-slip portions 61*b,* which are to be held by the fingers when sliding the detection member body 61, are formed respectively on opposite outer side surfaces of this detection member body 61.

The retaining projection 63 is formed on and projects from a lower surface of a retaining arm (resilient piece portion) 64, which is part of an upper wall of the detection member body 61, at a front end thereof, and this retaining projection 63 can be resiliently displaced upward. This retaining projection 63 is fitted into the retaining hole 42 from the upper side, with its front end surface held against a front end surface 42*a* (see FIG. 3) of the retaining hole 42, thereby holding the fitting detection member 60 in its initial position.

Arm projections 63*a* are formed respectively at opposite sides of the retaining projection 63, and when the fitting detection member 60 is engaged with the female connector 40, these arm projections 63*a* are engaged respectively in retaining recesses 43*b* which are formed in the housing body 40*b,* and are disposed respectively at opposite sides of the retaining hole 42. Therefore, even if the front end of the flexible lock arm 41 is elastically deformed downwardly to thereby cancel the engagement of the retaining projection 63 in the retaining hole 42 before fitting the female connector onto the male connector 50, the fitting detection member 60 will not be disengaged from the female connector 40.

In this embodiment, the proper fitting detection position, to which the fitting detection member 60 is slid, is set at a position which is nearer relative to the front end of the female connector 40 than the initial position (where the retaining projection 63 is retained by the retaining hole 42) is. Therefore, the female connector 40 is provided with a detection member-retaining portion 49 for limiting the sliding movement of the fitting detection member 60 when this fitting detection member 60 is slid from the initial position forwardly to the proper fitting detection position.

The detection member-retaining portion 49 is defined by the front end edge of the arm portion 45 of the flexible lock arm 41, and when the fitting detection member 60 is slid to the proper fitting detection position, this detection member-retaining portion 49 retains a rear gentely-slanting surface 63*b* (see FIG. 6) of the retaining projection 63, thereby locating and fixing the fitting detection member 60 in the proper fitting detection position. At this time, a click feeling is produced upon retaining engagement of the retaining projection 63 with the detection member-retaining portion 49, and therefore the completely-fitted condition of the female and male connectors 40 and 50 can be detected.

The deflection prevention rib 66 is disposed immediately adjacent to the rear end of the detection member body 61, and extends between opposite side walls of the detection member body 61. When the completely-fitted condition is achieved, this rib slides under the flexible lock arm 41. As a result, the deflection prevention rib 66 fills up a deflection space, and therefore even when a load is applied to the flexible lock arm 41, the flexible lock arm 41 is prevented from being elastically deformed. The deflection prevention rib 66 may take any suitable form, and does not always need to extend between the opposite side walls of the detection member body 61 in so far as it can generally fill up the deflection space for the flexible lock arm 41. Namely, the deflection prevention rib 66 may be interrupted intermediate the opposite side walls of the detection member body 61, and may comprise two cantilever sections.

A groove for receiving the deflection prevention rib 66 in the completely-fitted condition is formed at the rear end portion of the female connector 40, and this groove extends in the fitting direction. This groove has such a depth that the rear end of the detection member body 61 lies generally flush with the rear end of the female connector 40 in the completely-fitted condition. The height of this groove is generally equal to the height of the deflection prevention rib 66 so that the deflection prevention rib 66, when fitted in the groove, will not jolt.

The second projection 67 is provided on the inner peripheral surface of the detection member body 61, and when the completely-fitted condition is to be achieved, the fitting detection member 60 is moved toward the front side of the female connector 40, and the second projection 67 slides past the first projection 48, and is engaged therewith. Preferably, those surfaces of the first and second projections 48 and 67, which are brought into contact with each other when the fitting detection member 60 is moved from the initial position to the proper fitting detection position, are gently slanting so that the two contact surfaces can be easily engaged with each other. Also, those surfaces of the first and second projections 48 and 67, which contact each other when the fitting detection member 60 moves rearwardly from the proper fitting detection position, are abruptly slanting in order to prevent the rearward movement of the fitting detection member 60 in the completely-fitted condition.

With this construction, the force of retaining the fitting detection member 60 and the female connector 40 relative to each other is increased, and the fitting detection member 60 can be more firmly held in the proper fitting detection position. And besides, when the first projection 48 and the second projection 67 are engaged with each other, a click feeling is produced, and the completely-fitted condition of the female and male connectors 40 and 50 can be detected also by this click feeling.

Next, the fitting operation for the female and male connectors 40 and 50 and the fitting detection member 60 will be described with reference to FIGS. 3 to 6. First, before the female and male connectors 40 and 50 are fitted together, the retaining projection 63, formed on and projecting from the lower surface of the retaining arm (resilient piece portion) 64 (which is part of the upper wall of the detection member body 61) at the front end thereof, is fitted into the retaining hole 42 from the upper side, with its front end surface held against the front end surface 42*a* of the retaining hole 42, thereby holding the fitting detection member 60 in its initial position.

For fitting the female and male connectors 40 and 50 together, the engagement projection 51, formed on and projecting from that portion of the upper surface of the housing body 50*b* disposed near to the front end thereof, advances in sliding contact with the lower surface of the arm portion 45 of the flexible lock arm 41, as shown in FIGS. 4 and 5. When the length of fitting of the female and male connectors relative to each other reaches the predetermined value, the engagement projection 51 is fitted into the retaining hole 42 from the lower side of the arm portion 45, and therefore is engaged in this retaining hole 42.

At this time, the retaining projection 63 of the fitting detection member 60, already engaged in the retaining hole 42, is pushed upwardly out of this retaining hole by the engagement projection 51 as indicated by arrow B in FIG. 5, thereby canceling the holding of the fitting detection member 60 in the initial position. Therefore, the fitting detection member 60 can be moved toward the front side of the housing of the female connector 40.

Then, when the fitting detection member 60 is slid to the proper fitting detection position as shown in FIG. 6, the detection member-retaining portion 49, defined by the front end edge of the arm portion 45, retains the rear end surface 63*b* of the retaining projection 63, thereby holding the fitting detection member 60 in the proper fitting detection position.

When the completely-fitted condition is achieved, the fitting detection member 60 is slid to the proper fitting detection position, so that the deflection prevention rib 66, extending between the opposite side walls of the detection member body 61 at the rear end portion thereof, slides under the flexible lock arm 41, and fills up the deflection space. As a result, even when a load is applied to the flexible lock arm 41, this flexible lock arm is prevented from being elastically deformed since the deflection prevention rib 66 fills up the deflection space.

And besides, when the completely-fitted condition is achieved, the fitting detection member 60 moves toward the front side of the female connector 40, and the second projection 67 slides past the first projection 48, and is engaged therewith, thereby more firmly holding the fitting detection member 60 in the proper fitting detection position.

The female and male connectors 40 and 50 are completely fitted together, and the fitting detection member 60 is held in the proper fitting detection position, and in this condition the fitting detection member 60 is slid rearwardly from the position of FIG. 6 to the position of FIG. 5, so that the deflection prevention rib 66 is withdrawn from the deflection space below the flexible lock arm 41. Thereafter, the cancellation operating portions 45*a* are pressed down, thereby displacing the front end of the arm portion 45. By doing so, the engagement of the engagement projection 51 in the retaining hole 42 can be canceled, and the fitted condition of the female and male connectors can be cancelled. When the fitting detection member 60 is moved rearward, the rear gently-slanting surface 63*b* of the retaining projection 63 slides over the detection member-retaining portion 49.

As described above, in the half-fitting prevention connector 31 of this embodiment, the deflection prevention rib 66 extends between the opposite side walls of the detection member body 61 at the rear end portion thereof, and when the completely-fitted condition is achieved, this rib slides under the flexible lock arm 41. As a result, the deflection prevention rib 66 fills up the deflection space, and therefore even when a load is applied to the flexible lock arm 41, this flexible lock arm is prevented from being elastically deformed. Therefore, even when an external force is applied to the cancellation operating portions 45*a,* the flexible lock arm 41 will not be elastically deformed, and therefore the fitted condition of the female and male connectors 40 and 50 will not be canceled, and this fitted condition can be stably maintained.

And besides, when the completely-fitted condition is to be achieved, the fitting detection member 60 moves toward the front side of the female connector 40, and the second projection 67 slides past the first projection 48, and is engaged therewith. As a result, the force of retaining of the fitting detection member 60 on the female connector 40 increases, thereby more firmly holding the fitting detection member 60 in the proper fitting detection position. In addition, when the first projection 48 and the second projection 67 are engaged with each other, a click feeling is produced, and the completely-fitted condition of the female and male connectors 40 and 50 can be detected also by this click feeling.

As described above, in the half-fitting prevention connector of the present invention, the fitting detection member includes the detection member body, which is fitted on the outer periphery of the first connector housing so as to slide in the fitting direction of the first and second connector housings, the positioning retaining portion for engagement with the lock portion to hold the detection member body in the initial position, and the deflection prevention rib which is formed at the rear end of the fitting detection member so as to prevent the deflection of the lock arm in the completely-fitted condition. When the first and second connector housings are completely fitted together, the positioning retaining portion is pushed out of the lock portion upon engagement of the engagement portion with the lock portion, so that the engagement of the positioning retaining portion with the lock portion is canceled. When the detection member body is slid from the initial position to the proper fitting detection position generally near to the front end of the first connector housing, the positioning retaining portion is engaged with the detection member-retaining portion, formed at the distal end of the lock arm, thereby holding the fitting detection member in the proper fitting detection position, and also the deflection prevention rib is slid under the lock arm to prevent the deflection of the lock arm.

In the half-fitting prevention connector of the above construction, the deflection prevention rib for preventing the deflection of the lock arm in the completely-fitted condition is formed at the rear end of the fitting detection member mounted on the first connector housing, and when the completely-fitted condition is achieved, the deflection prevention rib slides under the lock arm to prevent the deflection of the lock arm. Therefore, even when a load is applied to the lock arm, the locked condition will not be canceled, thereby stably maintaining the fitted condition.

In the half-fitting prevention connector of the invention, having the above construction, the first connector housing has the first projection formed on that portion of the outer peripheral surface thereof facing away from the flexible lock arm, and the fitting detection member has the second projection which is formed on the inner peripheral surface thereof so as to be engaged with the first projection in the completely-fitted condition of the first and second connector housings. When the first connector housing is completely fitted with the second connector housing, the fitting detection member moves toward the front side of the first connector housing, so that the second projection slides past the first projection, and is engaged therewith.

In the half-fitting prevention connector of this construction, the first connector housing has the first projection formed on that portion of the outer peripheral surface thereof facing away from the flexible lock arm, and the fitting detection member has the second projection which is formed on the inner peripheral surface thereof so as to be engaged with the first projection in the completely-fitted condition of the first and second connector housings. When the first connector housing is completely fitted with the second connector housing, the fitting detection member moves toward the front side of the first connector housing, so that the second projection slides past the first projection, and is engaged therewith. Thus, the positioning retaining portion is engaged with the detection member-retaining portion, formed at the distal end of the lock arm, and in addition the first projection is engaged with the second projection. Therefore, the force of retaining of the fitting detection member on the first connector housing in the completely-fitted condition increases, thereby more firmly holding the fitting detection member in the proper fitting detection position. And besides, when the first projection and the second projection are engaged with each other, a click feeling is produced, and the completely-fitted condition of the first and second connector housings can be detected also by this click feeling.

What is claimed is:

1. A half-fitting prevention connector comprising:

a first connector housing having a flexible lock arm;

a second connector housing which has an engagement portion for engagement with a lock portion of said flexible lock arm, and is connected to said first connector housing by the engagement of said lock portion with said engagement portion when said second connector housing is fitted relative to said first connector housing; and a fitting detection member which is mounted on said first connector housing so as to slide in a fitting direction of said first and second connector housings, a half-fitted condition of said first and second connector housings being detected by determining whether or not said fitting detection member can be slidingly moved;

said fitting detection member including a detection member body, which is fitted on an outer periphery of said first connector housing so as to slide in the fitting direction of said first and second connector housings, a positioning retaining portion for engagement with said lock portion to hold said detection member body in an initial position, and a deflection prevention rib which is formed at a rear end of said fitting detection member so as to prevent the deflection of said lock arm in a completely-fitted condition;

wherein when said first and second connector housings are completely fitted together, said positioning retaining portion is pushed out of said lock portion upon engagement of said engagement portion with said lock portion, so that the engagement of said positioning retaining portion with said lock portion is canceled; and when said detection member body is slid from said initial position to a proper fitting detection position generally near to a front end of said first connector housing, said positioning retaining portion is engaged with a detection member-retaining portion, formed at a distal end of said lock arm, thereby holding said fitting detection member in said proper fitting detection position, and said deflection prevention rib is slid under said lock arm to prevent the deflection of said lock arm.

2. A half-fitting prevention connector according to claim 1, wherein said first connector housing has a first projection formed on that portion of an outer peripheral surface thereof facing away from said flexible lock arm, and said fitting detection member has a second projection which is formed on an inner peripheral surface thereof so as to be engaged with said first projection in the completely-fitted condition of said first and second connector housings, and when said first connector housing is completely fitted with said second connector housing, said fitting detection member moves toward the front side of said first connector housing, so that said second projection slides past said first projection, and is engaged therewith.

* * * * *